US008640713B2

(12) United States Patent
Fiebelkorn

(10) Patent No.: US 8,640,713 B2
(45) Date of Patent: Feb. 4, 2014

(54) VENTILATING SHEATH FOR SMOKING ARTICLE

(75) Inventor: Richard Fiebelkorn, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 205 days.

(21) Appl. No.: 13/055,433

(22) PCT Filed: Jul. 22, 2009

(86) PCT No.: PCT/GB2009/050901

§ 371 (c)(1),
(2), (4) Date: Apr. 7, 2011

(87) PCT Pub. No.: WO2010/010391

PCT Pub. Date: Jan. 28, 2010

(65) Prior Publication Data

US 2011/0180081 A1 Jul. 28, 2011

(30) Foreign Application Priority Data

Jul. 23, 2008 (GB) ..... 0813459.5

(51) Int. Cl.
*A24F 5/04* (2006.01)

(52) U.S. Cl.
USPC ..... 131/198.2; 131/198.1; 131/270; 131/272; 131/336; 131/365

(58) Field of Classification Search
USPC ..... 131/198.1–198.2, 20, 272, 336, 365
See application file for complete search history.

(56) References Cited

U.S. PATENT DOCUMENTS

| | | | | |
|---|---|---|---|---|
| 3,685,522 | A | 8/1972 | Kleinhans | |
| 4,446,877 | A | 5/1984 | Aikman | |
| 4,461,308 | A | 7/1984 | Le Cover | |
| 4,488,563 | A * | 12/1984 | Morifuji et al. | 131/336 |
| 4,498,487 | A | 2/1985 | Frattolillo | |
| 4,949,736 | A * | 8/1990 | Roberts et al. | 131/336 |
| 6,318,376 | B1 | 11/2001 | Cheng | |
| 2007/0074735 | A1 | 4/2007 | Gaworski | |

FOREIGN PATENT DOCUMENTS

| | | |
|---|---|---|
| CN | 1233436 | 11/1999 |
| DE | 95242 | 9/1896 |
| DE | 3225759 | 1/1984 |
| EP | 0160380 | 11/1985 |

(Continued)

OTHER PUBLICATIONS

Search Report for Chinese patent application No. 200980137154.2, filed Jul. 22, 1999.

(Continued)

*Primary Examiner* — Richard Crispino
*Assistant Examiner* — Eric Yaary
(74) *Attorney, Agent, or Firm* — N. W. Poulsen

(57) ABSTRACT

A sheath for a smoking article, such as a filter cigarette, including an exterior sheath (5) that provides a ventilation structure which has a reduced possibility of occlusion, and which also prevents a reduction in filter efficacy when the strength of the draw on the smoking article by the consumer is increased, for example in order to overcome the effects of dilution of the smoke flow with ambient air. The sheath may be manufactured as an independent entity and then fitted to prefabricated smoking articles, or alternatively may be constructed as an integral part of the smoking article.

17 Claims, 4 Drawing Sheets

(56) References Cited

FOREIGN PATENT DOCUMENTS

| | | | |
|---|---|---|---|
| EP | 1093728 | A | 4/2001 |
| EP | 1688052 | | 8/2006 |
| FR | 2423993 | | 11/1979 |
| GB | 2090117 | | 7/1982 |
| GB | 2136669 | A | 9/1984 |
| JP | 2004248570 | | 9/2004 |
| WO | WO2008099147 | | 8/2008 |

OTHER PUBLICATIONS

English translation of an Office Action issued by Chinese Patent Office to Chinese patent application No. 200980137154.2.

International Search Report and Written Opinion corresponding to PCT/GB2009/050901 mailed Dec. 29, 2009.

International Preliminary Report on Patentability corresponding to PCT/GB2009/050901 mailed Nov. 22, 2010.

* cited by examiner

VENTILATING SHEATH FOR SMOKING ARTICLE

CLAIM FOR PRIORITY

This application is a National Stage Entry entitled to and hereby claims priority under 35 U.S.C. §§365 and 371 to corresponding PCT Application No. PCT/GB2009/050901, filed Jul. 22, 2009, which in turn claims priority to British Patent Application Serial No. GB 0813459.5, filed Jul. 23, 2008. The entire contents of the aforementioned applications are herein expressly incorporated by reference.

The present invention relates to a sheath for a smoking article, such as a filter cigarette, which contains a smokable product such as tobacco.

BACKGROUND

Various types of composite filter constructions are known in the art for use with smoking articles that have a plurality of separate filter sections with different filtering capacities, made of different materials such as cellulose acetate and containing charcoal particles. However, while a portion of the total particulate matter (TPM) components of smoke can be removed by the use of composite filters, it is not possible to filter undesirable substances effectively from the gas phase (GP), which accounts for the majority of the total smoke.

One known way of reducing the delivery of unwanted GP components consists of diluting the gaseous smoke flow by introducing ambient air whenever the consumer inhales on the smoking article. This approach to reducing the concentration of GP components has several associated advantages. In particular, the consumer continues to receive the desired components and associated taste effects of the gaseous smoke flow. Furthermore, the cooler ambient air lowers the temperature of the smoke entering the mouth and throat, producing a more pleasant and agreeable smoking effect.

A number of means are known in the art whereby ambient air enters into the gaseous smoke flow of a smoking article. For example, the wrapping paper surrounding the filter, the smokable product, or both, may be made of porous material that allows ambient air to pass through and mix with the gaseous smoke flow within the smoking article. Alternatively, either or both of these wrappers may possess perforations or openings.

Generally, such ventilation structures are constructed as part of the filter tip rather than the rod of smokable material. This is for several reasons, not least because they would obviously otherwise be destroyed as the article is smoked. However, a general problem with the placement of ventilation structures in the filter tip is that they may become occluded by the consumer's fingers or mouth during actual smoking of the article. This will have the effect of reducing the level of dilution of GP components inhaled by the consumer.

The quantity and position of the ventilation holes, and their spatial relationship with the underlying components of the filter unit, determines the effect of the ventilation on the smoke delivery and hence on the smoking experience, and these features are carefully selected by the cigarette manufacturer. The effect will be altered if the ventilation is wholly or partially blocked. While smoking, it is possible that the smoker may inadvertently cover the ventilation holes with his fingers or mouth, thus changing the ventilation effect, which is undesirable.

To overcome this problem, various ways have been proposed to reduce the possibility of ventilation structure occlusion. One method in particular which has been utilised is to provide grooves or flutes to allow external air to penetrate the smoking article upon inhalation. According to this design, air enters the smoking article at a location close to or at the end of the filter tip furthest from the mouth. This area is less likely to become occluded by the fingers or mouth of the consumer.

EP 160380 discloses a cigarette with a tobacco rod that comprises a corrugated layer situated between the tobacco and the cigarette paper. In this manner the corrugated layer forms a series of conduits through which air is drawn as the consumer inhales. The disclosure is actually directed towards a means of strengthening the tobacco rod, and a drawback of the arrangement is that the proportion of the tobacco rod which actually comprises tobacco is significantly reduced.

A cigarette in which the filter tip comprises internal air conduits is disclosed in GB 2090117. Ambient air is able to enter these channels through perforations in the filter tip situated substantially mid-way between the mouth end and the tobacco end of the filter tip. The conduits are sealed at the tobacco end of the filter tip but are open at the mouth end to permit air to become drawn into the mouth upon inhalation where it can mix with the gaseous flow from the tobacco rod. An obvious drawback of this design is that the perforations through which air is able to enter the filter tip are located such that they could easily become occluded by the smoker.

EP 1688052 discloses a filter cigarette in which the core of filter material and a small proportion of the tobacco rod are surrounded by a ventilation passage. Ambient air is therefore directed along the ventilation passage and into the filter core to mix with the gaseous flow from the tobacco rod. The position along the tobacco rod at which ambient air enters the ventilation passages is unlikely to become occluded by the smoker.

U.S. Pat. No. 4,498,487 discloses a cigarette in which air is channelled into the filter via a series of passages opening at a position close to the mouth end of the tobacco rod. A very similar arrangement is disclosed in JP 2004 248570.

All of these prior attempts to address this problem comprise complex filter structures which are integral to the construction of the smoking article, which adds to the manufacturing cost.

It has been documented that there is a drawback to the dilution of GP components with ambient air by the use of ventilating structures. The suggestion is that in response to the ventilation of the gaseous smoke flow with ambient air, consumers draw on the smoking article with an increased velocity, which actually reduces filter efficacy. It is therefore an aim of the current invention to prevent consumers from inhaling excessive levels of GP components in the case of an increased strength of draw. The smoking article of the current invention satisfies this aim by providing a mechanism of increasing the level of ambient air entering the smoking article when the consumer draws strongly.

It is a further aim of the invention to provide a smoking article in which ventilation structures provide maximal dilution of gaseous smoke flow with ambient air, wherein the occlusion of these ventilation structures is minimised, and the ability of a consumer to inadvertently overcome these features is reduced.

SUMMARY OF THE INVENTION

According to a first aspect of the present invention, a sheath is provided for use in conjunction with a smoking article, the sheath providing an inlet for ambient air and further providing two possible routes for the ambient air flow when the sheath is used with a smoking article, the first route being through the sheath but not through the smoking article and the second route including flow through the smoking article.

The sheath may include a pressure sensitive valve openable to allow air flow along the first route.

In one embodiment, the valve blocks the first route below a given or predetermined threshold pressure differential, which may be between 10 cm/WG and 40 cm/WG, preferably 20 cm/WG. This means that the ambient air will flow into the smoking article, optionally through a porous wrapping or tipping paper surrounding the smoking article or through ventilation holes. The ambient air then mixes with the smoke travelling through the smoking article. When the air flow rate exceeds the threshold, for example when the smoker draws more strongly on the smoking article, the first route will open, thereby allowing the ambient air to by-pass the smoking article. This will reduce the effect of the strong draw, by increasing the flow of ambient air and preventing a significant increase in the amount of smoke inhaled. This also tends to avoid a reduction in the efficacy of any filter in the smoking article as a result of a stronger draw.

The sheath according to the first aspect of the present invention may comprise a substantially gas impermeable cylindrical tube.

The filter of the current invention may be constructed as an independent entity and then fitted to prefabricated smoking articles. Alternatively the sheath may be constructed as an integral feature of the smoking article.

Also, the sheath may be purchased independently of smoking articles. This reduces the number of steps in the manufacturing process and therefore the price of the smoking article, and secondly it allows the consumer to use the sheath in combination with any suitable smoking article.

The air inlet is preferably provided at the end of the sheath, more specifically at the end which is positioned away from the mouth when the sheath is attached to a smoking article and is used, referred to herein as the distal end. The inlet may be a gap between the sheath and the smoking article. This gap is formed as a result of the internal diameter of the distal end of the sheath being greater than the outer diameter of the smoking article. Alternatively, the inlet for the ambient air may be one or more holes in the sheath.

In another embodiment, a channel for the ambient air flow is formed between the sheath and the outer surface of the smoking article with which the sheath is to be used, for example, the channel may be formed by one or more fins on the interior thereof. The channel may extend longitudinally along the entire length of the sheath or just a portion thereof, preferably along a distal portion of the sheath.

The valve will preferably close a gap formed between the sheath and the smoking article surface. It may comprise an annular flexible valve member on the interior of the sheath. Alternatively, the valve may comprise a thin rubber seal which may, for example, be split into two or more sections. Alternatively, the valve may be a band of fibrous filaments, such as a band of hair filaments. The valve may also comprise a series of micro valves, which may be one-way valves.

The valve means may be positioned towards the proximal end of the sheath, that is, the mouth end of the sheath when it is in use.

The sheath according to the present invention may further include a means for attaching the sheath to the surface of a smoking article. In one embodiment, this means for attaching the sheath is a section of the sheath of reduced diameter to contact the outer surface of the smoking article when the sheath is in place. This section may hold the sheath in place with respect to the smoking article, either by providing a tight fit between the sheath and the smoking article or the inner surface of the sheath may be attached to the smoking article by an adhesive.

The section by which the sheath is attached to the smoking article may be gas permeable. This means that this part of the sheath does not block the first route of air flow and allows the ambient air to flow through the sheath without having to enter the smoking article. In some embodiments, the sheath may further comprise one or more ventilation holes.

In some embodiments, the sheath may be fitted to a smoking article, which may be a cigarette.

In one embodiment of the invention, the sheath comprises at least two sections. The first section is distal to the mouth of the consumer when the sheath is used in conjunction with a smoking article and comprises an inlet for the ambient air. This first section may also comprise channels through which the ambient air may flow. The second section is proximal to the mouth of the consumer when the sheath is used in conjunction with a smoking article and comprises the valve means. The sheath may further comprise a third section, which allows attachment of the sheath to the smoking article. This third section may be situated between the first and second sections and may be gas-permeable.

The sheath according to the first aspect of the present invention is suitable for use with a cigarette. The sheath may be positioned so as to at least partially surround the filter section of the cigarette. The second route of air flow then involves the ambient air entering the sheath through the air inlet, then being channelled into the tobacco rod or filter section of the cigarette, where it combines with the smoke flow and is eventually inhaled.

According to a second aspect of the present invention, a sheath for use in conjunction with a smoking article is provided, the sheath comprising a section of longitudinal fins to allow easy fitting of the sheath to a smoking article and to provide channels through which ambient air may be drawn. The sheath provides an air inlet at the end of the sheath which is formed from a gap between the sheath and the smoking article, as a result of the internal diameter of the distal end of the sheath being greater than the outer diameter of the smoking article. This arrangement of the air inlet means that it is much less likely to be occluded by the fingers or lips of a consumer.

The fins may extend inwardly by an amount sufficient to define the inner diameter dimensioned to engage with a smoking article. Optionally the fins extend inwardly by an amount sufficient to grip a smoking article within the sheath with an interference fit.

The fins may extend along part of the length of the sheath, and in this case, some or all of the remainder of the length of the sheath may comprise an annular section with a smaller internal diameter which will contact the outer surface of the smoking article when the sheath is in place. This annular section may be non-air-permeable, or air-permeable.

According to a third aspect of the present invention, a sheath for use in conjunction with a smoking article is provided, the sheath surrounding at least a portion of the smoking article when the sheath is in place and providing a gap between the surface of the smoking article and at least a portion of the inner surface of the sheath, the sheath comprising a sealing flap that may seal the gap between the sheath and the smoking article, the flap being moveable between a position in which it seals the gap and a position in which the gap is at least partially open. The sealing flap may be flexible.

According to a fourth aspect of the present invention, a smoking article is provided, the smoking article comprising a rod of smokable material, a sheath according to any one of the first, second, third, and fourth aspects of the invention and, optionally, a filter. The smoking article is preferably a cigarette with the sheath attached at the mouth end, at least partially surrounding any filter section. The sheath may be permanently or removeably attached to the smoking article.

BRIEF DESCRIPTION OF THE DRAWINGS

For a fuller understanding of the invention, reference is made to the accompanying drawings which illustrate an embodiment thereof given by way of example, in which.

It should be noted that none of the figures are to scale.

DETAILED DESCRIPTION

Figure 1:
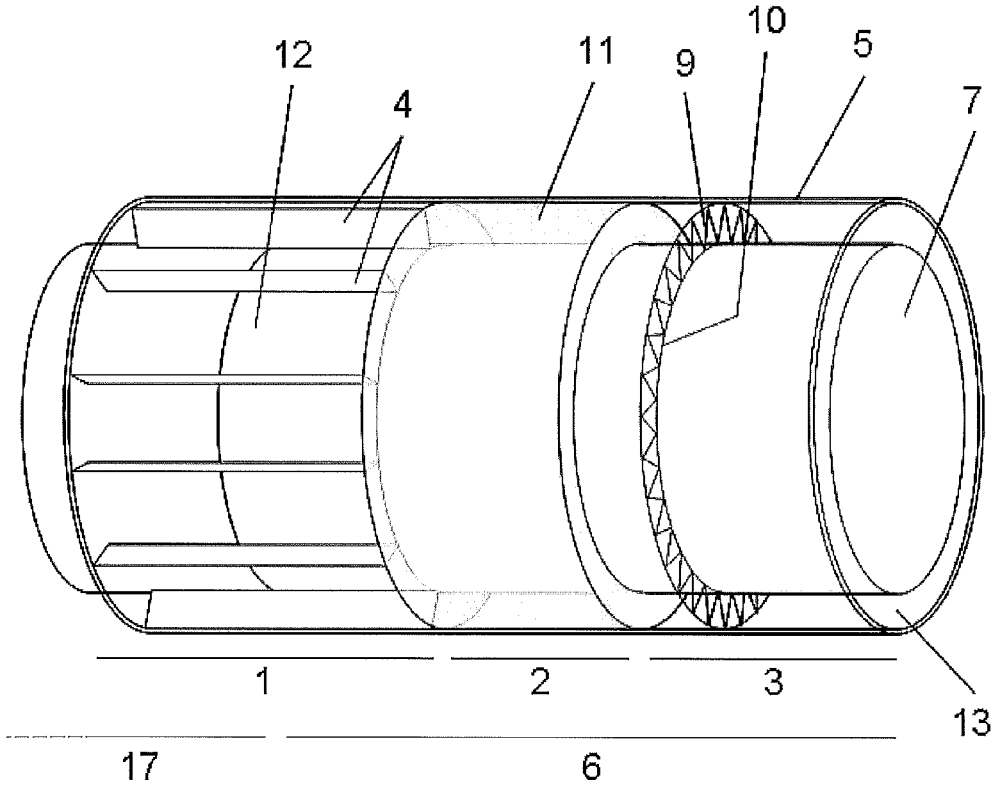
FIG. 1 shows a schematic side elevation view of the sheath with smoking article in situ.

Referring to FIG. 1, a substantially gas impermeable tube 5 is fitted to the mouth end of a filter cigarette that comprises a filter 6 and a tobacco rod 17, so as to surround the filter.

The length of the sheath 5 is dictated by a number of factors. It should be long enough to reduce the likelihood of the air inlet being occluded either by the consumer's fingers or lips. However, the sheath should not be so long that it comes into contact with the burning part of the smoking article during normal consumption. When the sheath is for use in conjunction with a cigarette having a filter section, it is desirable for the sheath to surround at least a portion of the filter section and may be of approximately the same length as the filter section or the tipping paper. In some specific examples, the sheath is between 10 and 45 mm in length, preferably between 15 and 35 mm, or approximately 25 mm in length.

The sheath shown in FIG. 1 is internally divided into three sections, a distal section 1 (situated at the end of the sheath furthest from the mouth of the consumer and closest to the rod of smokable material when the sheath is attached to a smoking article), a central section 2, and a proximal section 3 (situated at the mouth end when the sheath is attached to a smoking article).

The body of the sheath is composed of paper or card but can be made of other materials such as plastics or a natural material such as rubber, tobacco leaf, reconstituted tobacco leaf or other sheet material.

The smoking article may be a cigarette, cigarillo, cigar, or other smoking article. In some embodiments, the sheath is for use with slim cigarettes which have a circumference of between 16 mm and 18 mm. According to these embodiments the sheath may provide the consumer of the slim cigarette with the satisfying feel of smoking a wider cigarette, as a result of its diameter being greater than that of the slim cigarette.

The diameter of the sheath is also dictated by a number of factors. It should be wide enough to be able to surround the smoking article with which it is to be used. The internal diameter of the sheath may vary along its length, but it must be such that the sheath may be attached to the smoking article. Ideally, a gap is formed between the internal surface of at least part of the sheath and the smoking article. This gap should be large enough to allow the flow of ambient air, but should also be small enough to afford some degree of control over the air being drawn into and flowing through the sheath. The size of the gap should also be such that the sheath has sufficient structural integrity that it does not collapse when the consumer grips the sheath with his or her lips and/or fingers. The sheath diameter should also feel comfortable to the consumer, optionally with there being little or no detectable difference between the sensation of consuming a smoking article with or without a sheath.

Figure 2:
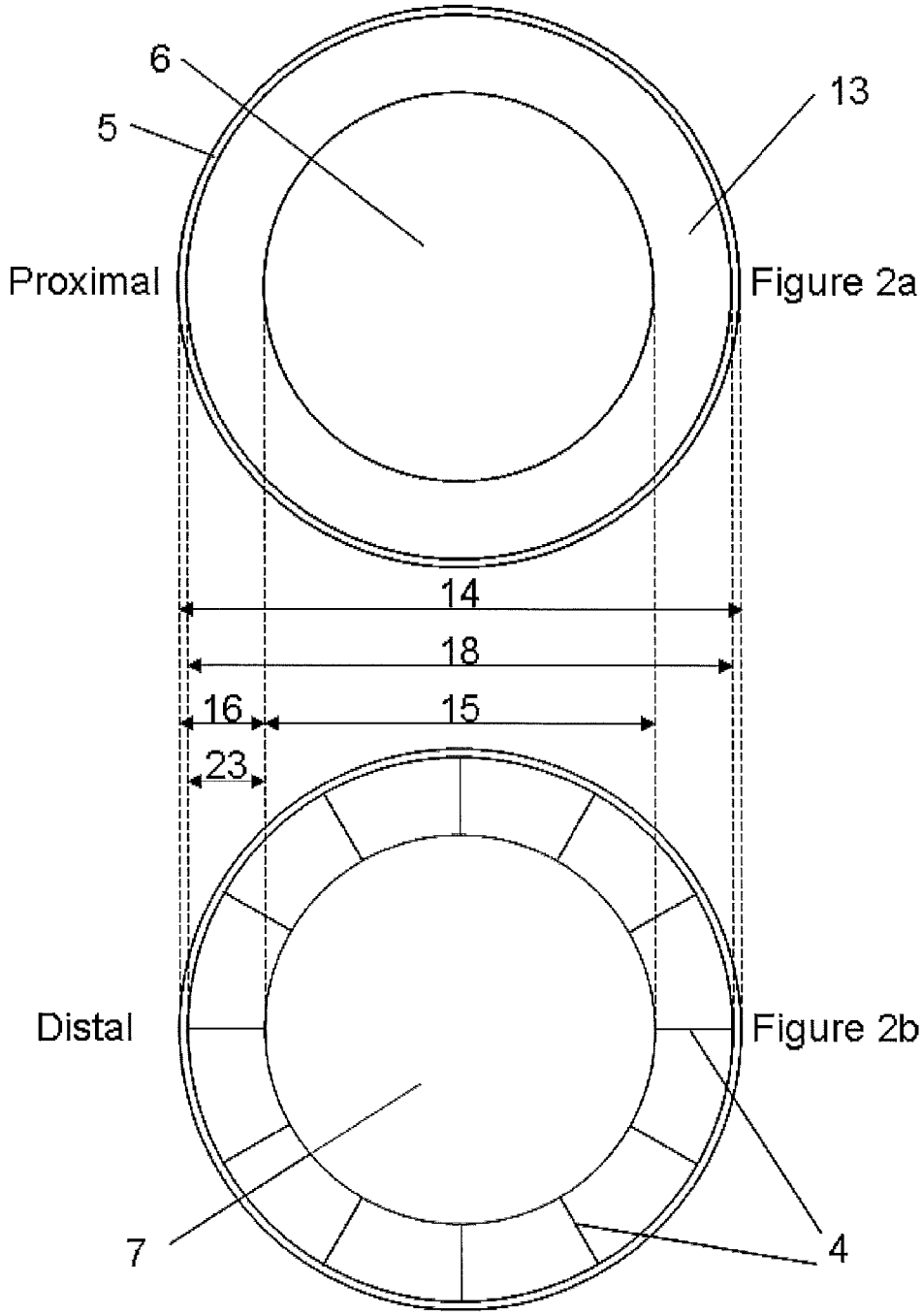
FIG. 2*a* shows an axial elevation of the mouth proximal end of an individual sheath, with smoking article in situ, according to the embodiment of FIG. 1.
FIG. 2*b* shows a cross sectional axial elevation of the distal (rod of smokable material) end of an individual sheath, with smoking article in situ, according to the embodiment of FIG. 1.

The distal section 1 of the sheath shown in FIG. 1 is designed to create an opening 13 around the smoking article when the sheath is attached and thus provide an inlet for ambient air to become drawn into the sheath. This opening is formed due to the internal diameter 18 of the distal section of the sheath being greater than the diameter 15 of the smoking article 7, as shown in FIG. 2*b*. The opening may, for example, be between 0.1 mm and 5 mm in width, preferably between 0.2 mm and 1.5 mm, or approximately 1.2 mm in width. In the embodiment shown in FIG. 1, the internal surface of the distal section of the sheath is characterised by a longitudinal series of fins 4, which protrude towards the diametric centre of the distal section. The length 23 of these protuberances is such that they contact the surface of the smoking article 7, as shown in FIG. 2*b*, thereby providing support for the sheath and ensuring that the opening is maintained. The protuberances may extend along any part of the length of the sheath that is desired; they may extend greater than half of the length of the sheath, or may be shorter, leaving an open annular passage around the smoking article. The number of the protuberances included may be varied and will affect the ease with which air may be drawn through the sheath and the structural strength of the sheath. In one embodiment, the distal section 1 of the sheath has between 1 and 20 protuberances, such as fins, and preferably between 6 and 12.

In an alternative embodiment, the fins may be replaced by a series of grooves or channels in the internal surface of the sheath.

The presence of this gap at the distal end minimises the possibility of a consumer occluding the ventilation structures of the smoking article. Firstly, the location at which ambient air enters the smoking article is away from the mouth end of the smoking article and hence away from the likely position of the fingers or mouth of the consumer. Secondly, the ventilation structure is difficult to occlude due to its being in an axial orientation compared to, for example, perforations on the surface of the sheath.

According to the embodiment shown in FIG. 1, ambient air which is drawn into the sheath via the distal section is able to penetrate the associated smoking article. This may be achieved by the smoking article possessing a suitable means of ventilation. In the embodiment shown in FIG. 1, the smoking article is ventilated by means of gas permeable tipping paper 12 which allows ambient air drawn through the sheath to enter the smoking article. In alternative embodiments, the filter tipping paper of the smoking article is ventilated by means of a series of perforations, or via other suitable means.

The proximal section 3 of the sheath shown in FIG. 1 also creates a gap 13, formed as a result of the internal diameter 18 of the proximal section being greater than the diameter of the smoking article 7 (FIG. 2*a*).

This proximal section 3 is configured so that ambient air that is passing through the sheath can be prevented from passing directly into the mouth through the annular gap 13 by means of a pressure sensitive valve which, in the embodiment shown in FIG. 1, comprises an annular sectioned, flexible flap 9 attached to the interior of the sheath. Under conditions of low pressure differential across the valve 9, the valve remains shut and in order to maintain a gas-impermeable barrier, the inner edge 10 of the circular seal makes a substantially air-tight contact with the surface of the smoking article thus completely closing the gap 13. However, the flap can open in response to an increased pressure differential to allow gas flow to the mouth through the gap 13, as explained below.

Figure 3A:
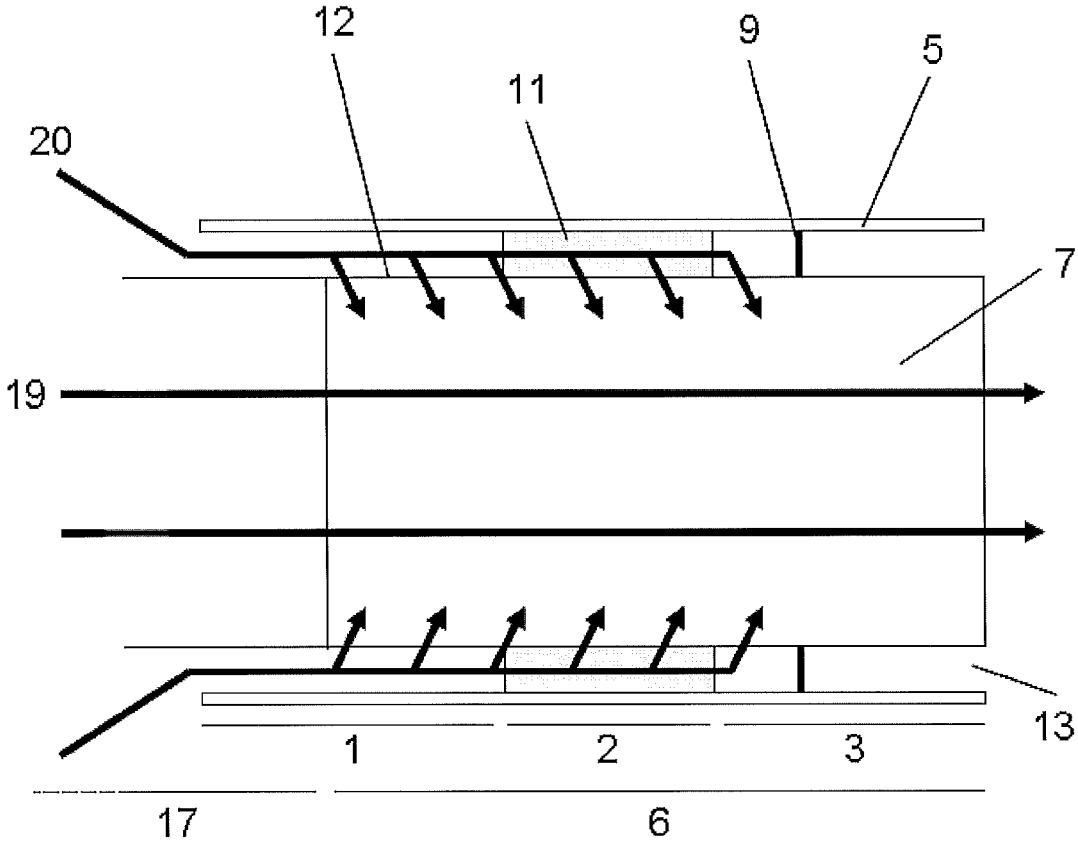
FIG. 3*a* shows a diagram of the sheath of FIG. 1, with smoking article in situ indicating the path of the gaseous smoke flow and ambient air within the smoking article and sheath under conditions of a normal strength of draw.

The route taken by ambient air 20 under conditions of a normal strength of draw in the embodiment of FIG. 1 is illustrated in FIG. 3*a*. Accordingly, ambient air 20 enters the sheath via the distal section 1 and is thus able to pass along the gap 13 between the sheath 5 and the smoking article 7. The tipping paper 12 of the smoking article is porous and ambient air 20 is drawn into the smoking article as it travels through the sheath from the distal end of the sheath to the circular seal 9 which will be in the sealed or closed position. The gaseous smoke flow 19 which is travelling through the smoking article is thus diluted inside the smoking article prior to inhalation.

In some embodiments, the smoking article is provided with perforations which allow the ambient air travelling through the sheath to penetrate the smoking article. Such perforations may be used, optionally in conjunction with a porous tipping paper, to control and direct the flow of ambient air into the smoking article.

Figure 3B:
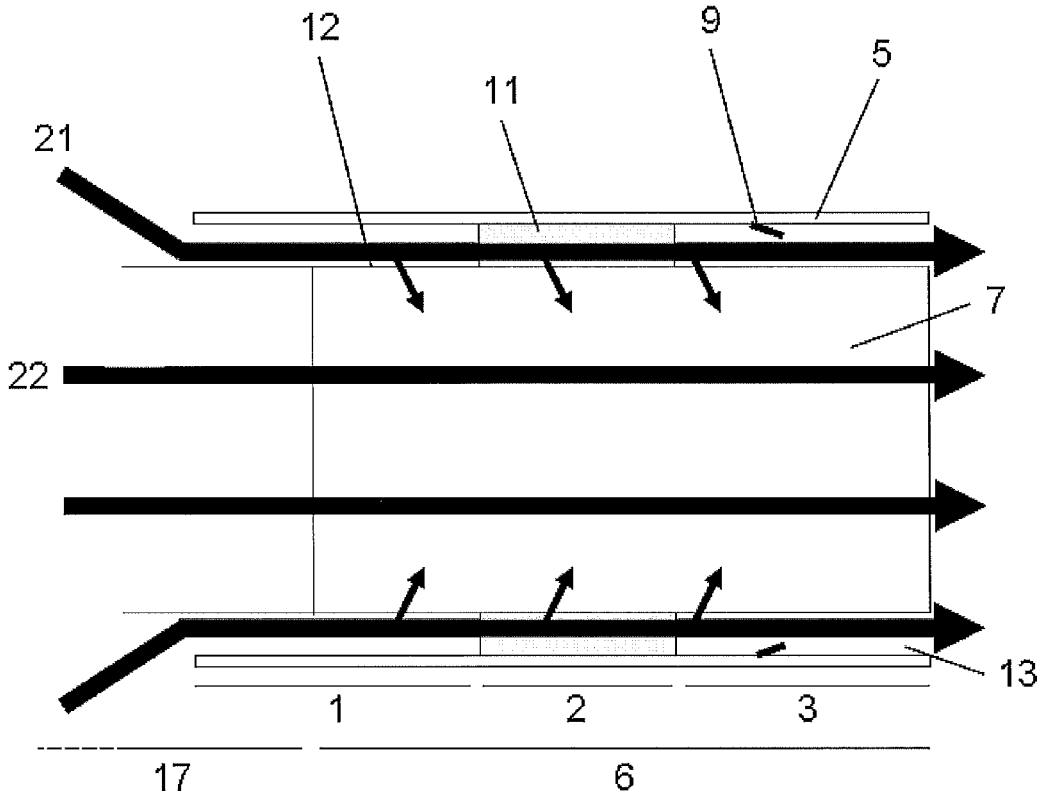
FIG. 3*b* shows the diagram as FIG. 3*a* indicating the path of the gaseous smoke flow and ambient air within the smoking article and sheath upon a high strength of draw.

The route taken by ambient air 20 under conditions of a higher strength of draw in the embodiment of FIG. 1 is illustrated in FIG. 3*b*. The valve 9 is opened as a result of the increased rate of air flow resulting from the stronger draw by the consumer, thereby allowing ambient air to pass through the proximal section of the sheath and into the mouth of the consumer without entering the smoking article.

According to some embodiments, the valve is arranged so that the proportion of ambient air passing through the valve versus that entering the smoking article increases in proportion with the strength of draw. In other embodiments, the valve is essentially in either an open or closed position. The air flow rate is affected by the strength of the draw on the smoking article and sheath by the consumer. The draw creates pressure drop and when this pressure drop value exceeds a given threshold, the valve opens. In some embodiments the valve opens at pressure drop values above 10 cm/WG. Optionally the pressure drop value at which the valve opens is 15 cm/WG, 20 cm/WG, 25 cm/WG, 30 cm/WG, 35 cm/WG, 40 cm/WG.

As illustrated in FIG. 3*b*, ambient air 21 is drawn into the sheath via the distal section 1 and passes through the gap 13 between the sheath 5 and the smoking article 7. In this scenario, however, due to the high strength of the draw by the consumer, the valve 9 is open and the ambient air 21 is able to continue through the proximal section of the sheath. This route through the sheath provides less resistance than the route through the smoking article and hence a higher proportion of the ambient air entering the sheath passes directly into the mouth, bypassing the smoking article entirely.

An important advantage of the sheath described herein is that it both inhibits the occlusion of ventilation structures of the smoking article, and prevents excessive levels of combustion products from being inhaled as a result of the consumer increasing the strength of draw to overcome the effects of dilution of the gaseous smoke flow. As shown in FIG. 3*b*, increased strength of draw will simply result in the increased intake of ambient air. As a result, the smoke 22 inhaled as a proportion of the total volume will not be increased to the same extent as with a conventionally ventilated filter, and may in fact be reduced. In a conventional smoking article, the rate at which the smoke travels through the smoking article will be increased as the strength of draw is increased. This can have a detrimental effect on the efficacy of any filtration that the smoke undergoes. However, the addition of a sheath as described herein means that the rate at which the smoke travels through the smoking article will be largely unaffected by the strength of draw, leading to better filtration being observed at high draw strengths.

In some embodiments the valve 9 comprises a plurality of sealing rings composed of a flexible material such as rubber. In other embodiments the valve comprises a sealing ring made up of several individual sections. The valve may also comprise a fine fibrous material such as a band of hair filaments, or the valve may comprise a series of one-way micro valves. In some embodiments the valve comprises more than one material, and may comprise a combination of two or more of the above valve arrangements.

In some embodiments, the proximal section of the sheath includes one or more perforations situated further from the mouth end of the sheath than the valve. This permits the entry of a greater amount of air into the sheath, and this air is able to bypass the distal and central sections to immediately increase the pressure on the valve. In these embodiments the gaseous smoke flow from the smoking article is subject to a greater air dilution, particularly in the case of strong draws.

The embodiment shown in FIG. 1 includes a central section 2, the function of which is to attach the sheath to the smoking article. This is achieved by means of the internal diameter of the central section being substantially equivalent to the diameter 15 of the smoking article 7. A tight binding may be achieved between the central section 2 of the sheath and the smoking article, to prevent their relative movement during the consumption of the smoking article. In the embodiment shown in FIG. 1, an adhesive is applied to the internal surface of the central section to permanently bind the sheath and smoking article. In alternative embodiments, other suitable methods of attachment are utilised to bind the sheath and smoking article.

The central section 2 may be composed of a gas permeable material 11, in order to allow the ambient air to flow from the distal section to the proximal section of the sheath. Air is also able to pass from the porous material 11 of the central section into the filter tip of the smoking article 7. The precise nature of the gas permeable material may be chosen in order to provide different levels of gas permeability, thereby controlling the air flow through the sheath. A less porous material will encourage more of the ambient air to flow into the smoking article even when the route through the sheath is otherwise open. Thus, the porosity of this material will control the amount of ambient air entering the proximal section of the sheath and thus the mouth.

In some embodiments the central section is composed of solid, impermeable material in which air passages are created.

In some embodiments the sheath comprises a distal section and a proximal section with no central section. In these embodiments, the sheath may be held in place by an interference fit between the fins of the distal section and the smoking article. The longitudinal length of the fins and the number and circumferential arrangement of the fins can be selected to provide an adequate gripping function. If the fins are configured to be resilient, with a radial extent such as to provide a central space with a diameter slightly less than that of the diameter of the smoking article, the interference fit may be improved, with the fins deformed slightly as they hold the smoking article. Further, the fins need not be straight in the longitudinal direction, or aligned parallel with the longitudinal direction. Instead, they may be curved, or angled, or have some other non-linear shape, or be aligned at an angle or along a helix, which may be found to provide a more secure interference fit. Alternatively, if the inner ends of the fins have a sufficient surface area, the smoking article can be held inside the sheath by gluing to the fins.

In other embodiments, the sheath comprises the central and proximal sections but lacks the distal section. Accordingly, ambient air is drawn into the sheath via the air permeable material of the central section. The central section may be air permeable, or alternatively, in the case that vent holes are provided in the outer wall of the sheath, the central section may comprise material that is impermeable.

In some embodiments, the sheath comprises the distal and central sections 1 and 2, but does not have a proximal section. Clearly in this embodiment, the sheath functions to protect the ventilation means of the smoking article engaged within the sheath. In some of these embodiments the sheath is intended for retro-fit use, and may be reused repeatedly. Accordingly, the sheath of these embodiments may be retailed with smoking article in situ or may be retailed independently of the smoking article to enhance the ventilation and minimise the occlusion of standard smoking articles.

A ventilating sheath according to the present invention may be used with tobacco rod-based smoking articles with a range of ventilation arrangements. Smoking articles having a conventional filter unit with one or more rings or zones of ventilation holes in the tipping paper have been discussed above. The shielding offered by the sheath allows the ventilation holes to be distributed over a wider area than is conventionally possible. A wide distribution of holes is likely to suffer at least partial blocking by the smoker in the absence of a ventilating sheath, thus reducing the ventilation below the intended level. The present invention offers the opportunity to use many more ventilation holes, or a conventional amount of holes distributed over a larger area, thus opening up a wider range of ventilation configurations that is currently feasible. The benefit is not limited to ventilation provided by rings or zones or holes, either. The tipping paper itself may be much more porous than conventional tipping paper. For a conventional design of filter-tipped smoking article, the tipping paper is substantially non-porous to make it robust enough to withstand finger and mouth contact during smoking. Hence, holes in the tipping paper are employed to provide ventilation. If a ventilating sheath is used instead, the finger and mouth contact is with the sheath rather than the tipping paper. This allows a porous tipping paper to be used, whereby air can enter the filter directly through the tipping paper. This offers different ventilation effects than can be achieved by ventilation holes alone, and also removes the need to make the ventilation holes. Also, a combination of ventilation holes and porous tipping paper may be used. Further, the ventilating sheath may be used with a non-filter-tipped smoking article that has ventilation means at or near its mouth end, such as ventilation holes in the paper wrapper of the tobacco rod, or a porous paper wrapper at the mouth end. In summary, any smoking article having an air-permeable wrapper at its mouth end, whether the wrapper is related to a filter unit or not, may be used with a ventilating sheath according to the invention.

In some embodiments the sheath is added during the manufacture of the smoking article. The sheath may be manufactured with the smoking article as a single article or the sheath and smoking article may be manufactured independently and joined in a final manufacturing step.

The sheath may be manufactured by adhering the internal components to one side of a piece of flat material and then wrapping the material to form a substantially cylindrical shape. Alternatively, the sheath may be manufactured by prefabricating the material around a former. The sheath may be manufactured in discrete units, or longer sections comprising many sheath units may be produced and subsequently cleaved.

In other embodiments, the sheath is attached to the smoking article by the consumer.

The invention claimed is:

1. A smoking article sheath comprising:

an inlet for ambient air; and two routes for the ambient air flow, the first route being through the sheath but not through the smoking article and the second route including flow through the smoking article, wherein the sheath includes a pressure sensitive valve openable to allow air flow along the first route.

2. The sheath as claimed in claim 1, wherein the valve blocks the first route below a given or predetermined threshold pressure differential.

3. The sheath as claimed in claim 2, wherein the threshold pressure differential is between 10 cm/WG and 40 cm/WG.

4. The sheath as claimed in claim 1, wherein the valve comprises an annular flexible valve member on the interior of the sheath.

5. The sheath as claimed in claim 1, wherein the valve comprises a band of fibrous filaments.

6. The sheath as claimed in claim 1, wherein the valve comprises a series of micro valves.

7. The sheath as claimed in claim 1, wherein the sheath comprises a substantially gas impermeable cylindrical tube.

8. The sheath as claimed in claim 1, wherein the inlet for ambient air is at an end of the sheath and is a gap between the sheath and the smoking article.

9. The sheath as claimed in claim 1, wherein the inlet for the ambient air is one or more holes in the sheath.

10. The sheath as claimed in claim 1, wherein a channel for the ambient air flow is formed between the sheath and the outer surface of the smoking article.

11. The sheath as claimed in claim 10, wherein the channel is formed by one or more fins on the interior thereof.

12. The sheath as claimed in claim 1, comprising a means for attaching the sheath to the surface of the smoking article.

13. The sheath as claimed in claim 12, wherein the means for attaching the sheath is a section of the sheath of reduced diameter, the section contacting the outer surface of the smoking article when the sheath is in place.

14. The sheath as claimed in claim 13, wherein the section of the sheath is gas permeable.

15. The sheath as claimed in claim 14, wherein the sheath further comprises one or more ventilation holes.

16. The sheath as claimed in claim 1, wherein the sheath is fitted to the smoking article.

17. The sheath as claimed in claim 16, wherein the smoking article is a cigarette.

* * * * *

UNITED STATES PATENT AND TRADEMARK OFFICE

CERTIFICATE OF CORRECTION

PATENT NO. : 8,640,713 B2
APPLICATION NO. : 13/055433
DATED : February 4, 2014
INVENTOR(S) : Fiebelkorn It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 280 days.

Signed and Sealed this
Fifth Day of August, 2014

Michelle K. Lee

Michelle K. Lee
*Deputy Director of the United States Patent and Trademark Office*